United States Patent [19]

Ogawa

[11] Patent Number: 4,537,563

[45] Date of Patent: Aug. 27, 1985

[54] RAM PUMPS

[75] Inventor: Tetsuo Ogawa, Kawasaki, Japan

[73] Assignee: Katsuhiko Ohki, Briarcliff Manor, N.Y.

[21] Appl. No.: 484,870

[22] Filed: Apr. 14, 1983

[51] Int. Cl.[3] ..... F04F 7/02; F16K 51/00

[52] U.S. Cl. ..... 417/226; 251/147

[58] Field of Search ..... 417/226; 251/352, 121, 251/147

[56] References Cited

U.S. PATENT DOCUMENTS

| | | | |
|---|---|---|---|
| 10,079 | 10/1853 | Strode | 417/226 |
| 715,167 | 12/1902 | Snavely | 417/226 |
| 758,259 | 4/1904 | Kline | 417/226 X |
| 767,516 | 8/1904 | Foster | 417/226 |
| 4,054,399 | 10/1977 | Maurer | 417/226 |

FOREIGN PATENT DOCUMENTS

| | | | |
|---|---|---|---|
| 7967 | 1/1852 | France | 417/226 |
| 183599 | 11/1982 | Japan | 417/226 |
| 183598 | 11/1982 | Japan | 417/226 |
| 183597 | 11/1982 | Japan | 417/226 |
| 183600 | 11/1982 | Japan | 417/226 |

*Primary Examiner*—Cornelius J. Husar
*Assistant Examiner*—Peter M. Cuomo
*Attorney, Agent, or Firm*—Wender Murase & White

[57] ABSTRACT

An improved ram pump of the type having a pump housing (7) an inlet (8) for intake of fluid, a reservoir (10) for supply of a dynamic fluid head to the pump, a release valve mechanism (11) for exhaust of fluid from the pump and a lift valve mechanism (12) for output of back pressure generated by the pump. The improvements comprise a partially spirally wound lead pipe (9) connecting the reservoir to the pump inlet, an adjustable release valve mechanism (11) having a valve cup (13) and annular adjustment ring (21) which cooperate to form variable outlet ports (23) that selectively restrict exhaust of fluid to vary the height of fluid above the valve (16) and a lift valve mechanism (12) biased at a pressure greater than approximately 10 gm/cm$^2$.

6 Claims, 6 Drawing Figures

Fig. 1
PRIOR ART
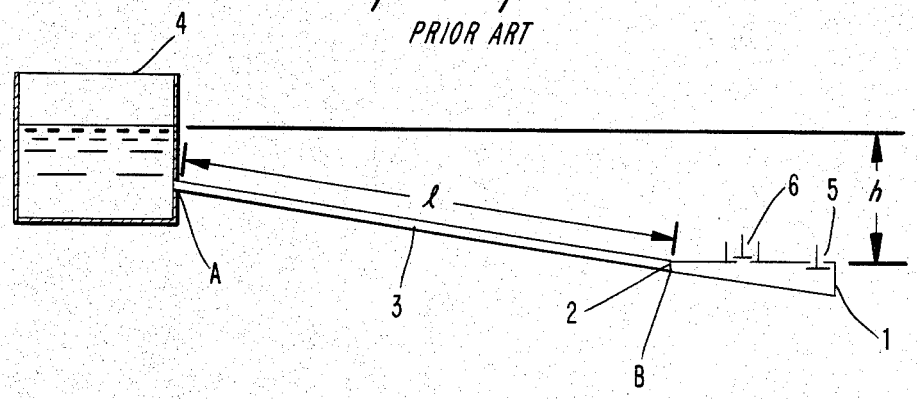
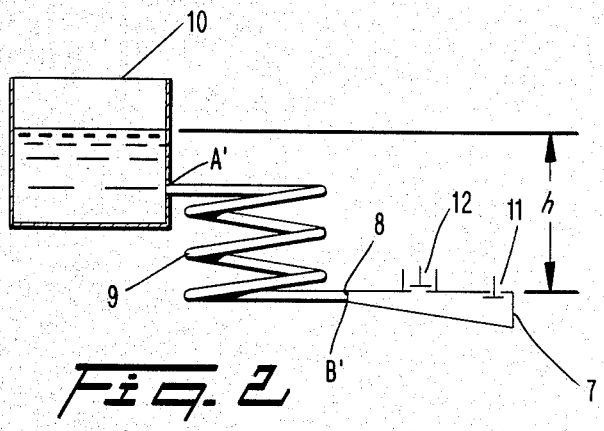
Fig. 2
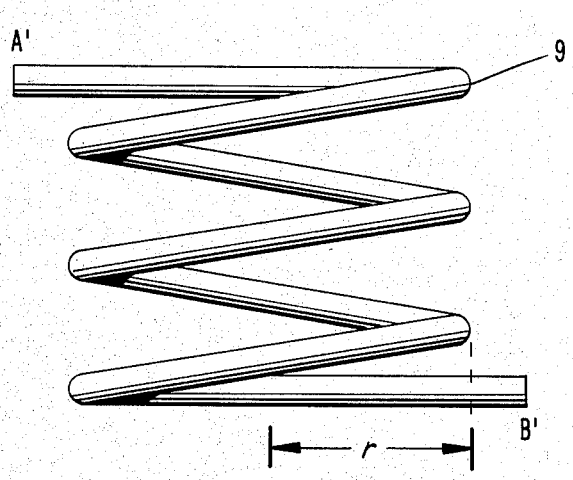
Fig. 3

RAM PUMPS

BACKGROUND OF THE INVENTION

1. Field of the Invention

The invention relates to improvements in fluid ram pumps.

2. Description of the Prior Art

In fluid mechanics, it is generally known that an abrupt stop in fluid flow through a pipe will rapidly generate a back pressure of magnitude many times that generated by the dynamic flow. Many people have experienced this phenomenon in their domestic water systems when they quickly shut off a water valve. This phenomenon is commonly known as "water hammer".

In the past, attempts have been made to harness the back pressure to perform useful work, such as vertically pumping high pressure fluid. These pumps are known as ram pumps.

Past designs of ram pumps have had a pump housing or body containing gas, such as air, and having an inlet connnected by a lead or head pipe to a source of flowing fluid, such as a water reservoir located at some height above the pump. Water flows under the influence of gravity from the reservoir through the lead pipe, the pump inlet and in turn into the housing. The housing also has a release valve for water exhaust from the pump; rapid, abrupt closure of that valve creates a pressure increase in the pump housing which compresses air trapped in the housing. In theory, the housing pressure increase opens a lift valve, which allows the compressed air to expand and push water output through the lift valve and out of the pump. The output has a pressure greater than the hydrostatic pressure generated by the dynamic head flowing through the pump and can be used to perform useful mechanical work, such as pressurizing a municipal water system. Also in theory, repeated opening and closing of the release valve repetitively recreates back pressure waves which in turn activate the lift valve and perform useful work.

Ram pumps have had minimal acceptance in the past for three main groups of practical reasons—pump inefficiency, geometric restraints on lead pipe construction and inability to achieve theoretically attainable automatic pump operation. Inefficiency manifests itself in low pressure output through the lift valve. The lead pipes have had to be constructed with relatively long length and they could not be used under some geographic conditions.

Nonautomatic operation has been the result of the failure of past designs to coordinate opening and closing of the release and lift valves and failure to allow proper volumes of air into the pump housing. In theory, closure of the release valve would generate a pressure increase in the pump housing, which compresses air trapped therein. The lift valve would be constructed with biasing means to open at a predetermined pressure level so that the compressed air would expand and drive water out of the pump. Opening the lift valve would eventually decrease the pump housing pressure. Unfortunately, known ram pump designs have not supplied the proper volumes of air into the pump housing which are necessary to attain an output head under automatic operation. During automatic operation, some air is constantly dissolved into the water, decreasing air volume. When the air volume decreases below a critical level, automatic operation terminates. If an excessive volume of air is supplied into the pump housing, the back pressure will only compress and lift air rather than lift water, which hampers pump efficiency.

If the release valve is constructed so that it automaticaly biases to the open position, the valve will open, allowing more water to flow through the pump body from the reservoir. At least in theory, carefully adjusting the release valve bias force will allow the valve to close once the hydrostatic pressure caused by flowing water through the pump is attained; the release valve then closes, setting up another pressure shock which repeats the lift valve opening process. Unfortunately, it has not been heretofore possible to construct a ram pump having efficient, fully automatic operation.

SUMMARY OF THE INVENTION

An improved ram pump constructed in accodance with the teachings of the present invention provides for efficient automatic operation at higher output pressure levels then heretofore experienced.

One embodiment of the invention is an improved ram pump of the type having a pump housing, a lead pipe having an axial dimension, where the pipe is connected to the housing for inflow of fluid into the housing, a reservoir located above the pump housing connected to the lead pipe for supplying a source of a fluid head, a release valve mechanism and a lifting valve mechanism. The improvement comprises a portion of the lead pipe being spirally wound in the longitudinal dimension.

Another embodiment of the invention is an improved ram pump of the type having a pump housing, a lead pipe connected to the housing for inflow of fluid, a reservoir located above the pump housing connected to the lead pipe for supplying a source of a fluid head, a release valve mechanism, and a lifting valve mechanism. The improvement comprises a release valve mechanism having an outlet defined by the housing for exhaust of fluid from the pump; a release valve cup is attached to the housing and cooperates with the outlet, where the cup defines cup slots communicating with the outlet; an adjusting ring defines slots through the ring in the radial direction, the ring is adapted for communication with and slidable rotation about the release valve cup. The ring slots cooperate with the valve cup slots to form an outlet port, such that rotation of the ring varies the cross section of the outlet port. A valve having a stem portion is slidably mounted in the valve cup for reciprocating movement of the valve from an open position to a closed position, such that the valve blocks the outlet in the closed position and does not block the outlet in the open position.

In other embodiments of the invention, the valve has means for selectively adjusting the distance of valve reciprocation from the open position to the closed position.

BRIEF DESCRIPTION OF THE DRAWINGS

FIG. 1 is a schematic-elevational view of a prior art ram pump;

FIG. 2 is a schematic-elevational view of one embodiment of the present invention;

FIG. 3 is an elevational view of a lead pipe constructed in accordance with the teachings of the present invention;

DESCRIPTION OF THE PREFERRED EMBODIMENTS

A. Prior Art

Figure 5:
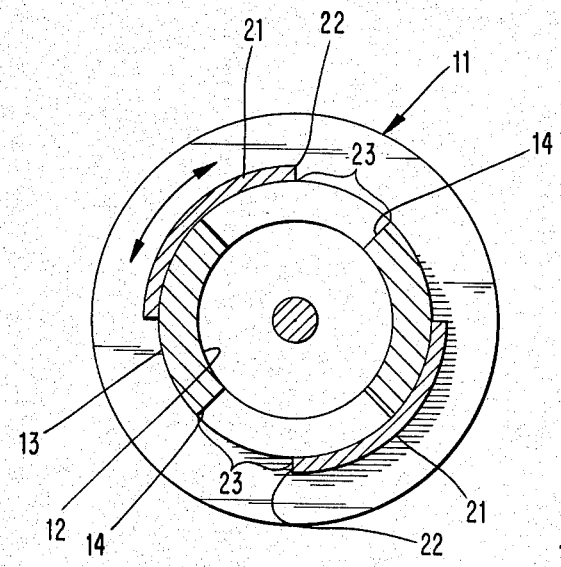
FIG. 5 is a cross-sectional-plan view of a release valve constructed in accordance with the teachings of the inventions taken along 5—5 of FIG. 4.

A known ram pump is schematically shown in FIG. 1. The pump has a pump housing 1 and an inlet 2 for intake of a moving fluid, such as water. The source of flowing water is a lead pipe 3 which is connected to a storage reservoir 4. The vertical distance between the reservoir 4 water level and the release valve 5 is represented by the distance h. Water exhausts from the pump body 1 through release valve 5, which is selectively closeable in order to stop waterflow. Closing release valve 5 stops the flow and in turn creates a back pressure wave or hammer. Useful work is performed by the pressure wave by diverting it through lift valve 6, which is set to open at a predetermined pressure. When the back pressure wave strikes lift valve 6, the valve opens, diverting the pressure wave to where it may perform useful work. This useful work may provide a municipal water system with a higher pressure head than the hydrostatic head created by the gravitationally induced flow through the distance h.

The known ram pump drawbacks have obviated widespread practical use at suitably high output pressure levels. First, the lead pipe 3 geometry necessary to create a desired output pressure head takes up a great deal of space (as will be explained below) and it is not suitable for hilly terrain. Second, automatic operation of the pumps has not been achieved at useful output pressure heads. The present invention solves these technical difficulties.

B. Lead Pipe

In order to achieve useful back pressure, it is generally thought that the length L of the lead pipe, such as shown in the Prior Art FIG. 1, must be greater than eight times that of the gravitational head h. It is further commonly thought that the lead pipe must extend in a straight line from the reservoir to the pump in order to maximize back pressure head for a given reservoir head and flow rate. Bends or restrictions in the lead pipe increase water flow friction through the pipe and thus decreases the back pressure head.

However, in practice it is difficult or nearly impossible to achieve the desired eight to one ratio. For example, if the reservoir head (also called the dynamic head or effective head) is 10 m, the lead pipe should be 80 m long, and be free of any bends. Long straight runs of piping may be impractical in urban areas, areas with steep terrain or hilly areas having great elevational fluctuations. The optimal geometric lead pipe configurations might not be possible without costly deep excavations.

Lead pipes constructed in accordance with the teachings of the present invention provide for more compact design flexibility for utilization in geographic terrain heretofore thought to be unsuitable for ram pumps. The present lead pipes also create higher back pressures and greater output pressure than the known lead pipe designs, when both operate under similar parameters.

Referring to FIG. 2, pump housing 7 has an inlet 8 connected to the improved lead pipe 9. Lead pipe 9 connects to reservoir 10. The pump housing 7 has a release valve mechanism 11 and a lift valve mechanism 12. As shown in FIGS. 2 and 3, lead pipes constructed in accordance with the teachings of the present invention are wound in a spiral or helical configuration. The helical winding design creates a higher back pressure than straight lead pipes operating under identical parameters. This difference is shown by way of the following experimental examples.

EXAMPLE 1

A straight lead pipe of 40 mm diameter and 8 m length was connected between a water reservoir and a ram pump. The effective head between the reservoir and pump was 1 m. A maximum output lift, or output head of 21 m was obtained.

EXAMPLE 2

A 40 mm diameter lead pipe having a length of 8 m was helically wound into a diameter of 75 cm (radius, R=37.5 cm). Again, the effective head was 1 m. The maximum lift head that was obtained was 28 m.

EXAMPLE 3

A 40 mm diameter lead pipe having a length of 8 m was partially wound into a helix having a diameter of 40 cm. The end portions were in a straight unbent configuration and connected to the reservoir and ram pump. The reservoir head was 1 m. The maximum lift head that was obtained was 19 m.

EXAMPLE 4

A 50 mm diameter lead pipe having a length of 8 m was partially wound into a helix having a diameter of 40 cm. The unwound ends had both straight and bent portions to simulate elbows and turns. The reservoir head was 1 m. Maximum lift height that was obtained was 26 m.

The above examples are summarized in the following Table No. 1:

TABLE 1

| EXAMPLE NO. | LEAD PIPE DIAMETER (mm) | HELICAL DIAMETER (cm) | MAXIMUM OUTPUT HEAD |
|---|---|---|---|
| 1 | 40 | — | 21 |
| 2 | 40 | 75 | 28 |
| 3 | 40 | 40 | 19 |
| 4 | 50 | 40 | 26 |

The above examples show that a helically-wound lead pipe can be constructed which will create a higher lift head than the heretofore optimally-designed prior art straight lead pipes. The helix may be wound relatively tightly and still create maximum lift heads that approach that of the prior art designs (see example 3), while providing a geometric configuration that can fit into a more compact area. Lastly, an increase in the lead pipe diameter can compensate for bends or turns in the lead pipe, and still provide relatively high maximum lift heads.

As the experimental results show, a partially helically wound lead pipe may be designed to create higher lift head pressures than prior straight lead pipes, which may have application for much more demanding terrain.

C. Release Valve Mechanism

Figure 4:
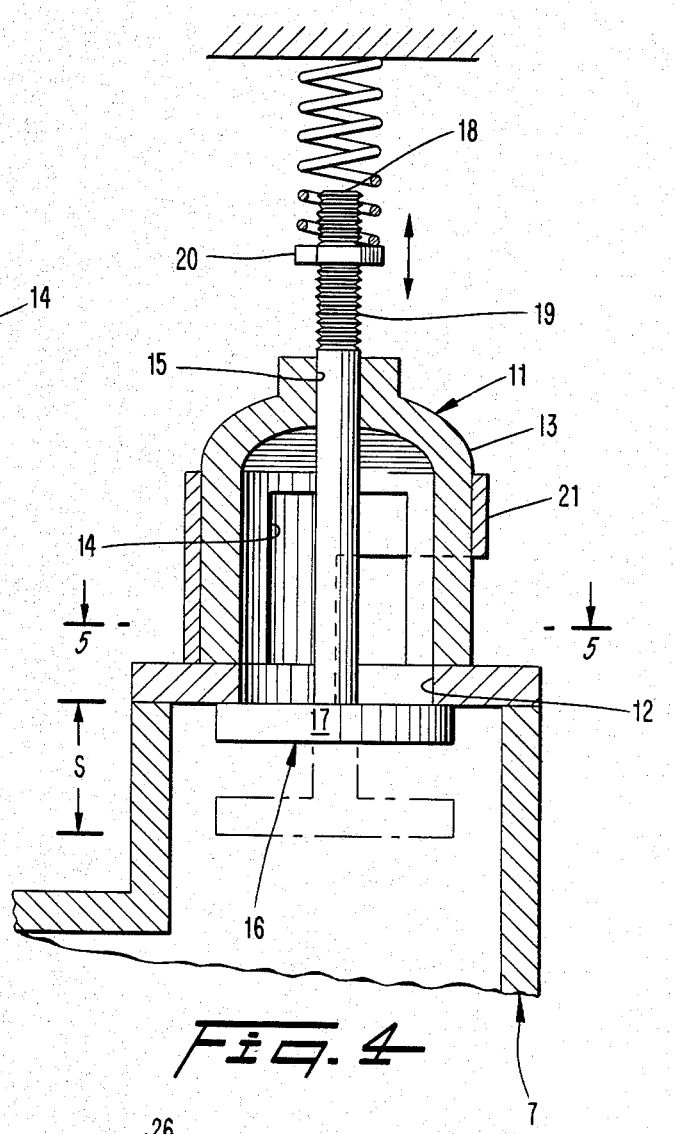
FIG. 4 is an elevational-cross-sectional view of a release valve constructed in accordance with the teachings of the present invention.

FIGS. 4 and 5 show a release valve mechanism constructed in accordance with the teachings of the present invention. Referring to the figures, release valve mechanism 11 has a valve outlet 12 through the pump housing 7. The outlet 12 opens into a valve cup 13 which, as shown, has the form of a cylinder with a domed outer end. The valve cup 13 has slots 14 for passage of water therethrough once the water drains from valve outlet 12. The valve cup end opposite the outlet 12 has a bore 15 therethrough along the cup's (13) longitudinal axis. Valve 16 has a head 17 that cooperates with outlet 12 to seal the outlet when the valve is in a closed position. Valve 16 also has a stem 18, which slidably inserts into the valve cup bore 15 and reciprocates from an open position to a closed position. In the open position, valve head 17 is spaced a distance s away from valve outlet 12. The distance s is also known as the stroke. In the closed position, valve head 17 presses against valve outlet 12 to seal pump housing 7. Stem 18 has a threaded upper portion 19 for receipt of a threaded nut 20. Changing the position of threaded nut 20 varies the stroke s.

The release valve mechanism 11 has an annular adjustment ring 21 adapted for placement over the outer circumference of the valve cup 13. Ring 21 has ring slots 22 that go through the ring around its perimeter. Ring slots 22 cooperate with valve cup slots 14 to form outlet ports 23. Rotation of ring 21 varies the cross section of these ports 23, and thus the available cross-sectional area through which water exiting pump housing 7 may flow.

Decreasing the cross-sectional size of outlet port 23 decreases the exhaust flow rate through pump housing 7. If the inflow rate of water into pump housing 7 through inlet 8 remains constant, decreasing the size of outlet port 23 will raise the height of water in valve cup 13 above valve 16.

The water level above valve 16 affects the output pressure and quantity of water lifted through lift valve 12. When the size of outlet port 23 is increased, the water level decreases, leaving more room for air in the pump housing 7. Conversely, decreasing the outlet port 23 size decreases the volume of air in the pump housing 7. Thus, the present invention provides an accurate means for metering the volume of air contained within the pump housing 7, which may be optimized for maximum pump output. The effects of port 23 cross-sectional area on the quantity of water lifted is shown by the following example.

EXAMPLE 5

In the example, a 50 mm diameter adjustment ring 21 was used over valve cup 13. Adjustment ring 21 was tested for two sets of operating conditions. In the first set of conditions, a 2 m reservoir head was used in conjunction with 15 m lead pipe, and the pump was adjusted to provide a 20 m water output head. In the second set of operating conditions, a 6 m reservoir head was combined with a 40 m lead pipe. The pump was adjusted to provide a 150 m water lift head. Under both sets of conditions, the adjustment ring 21 was used to vary the water level above the release valve to a preselected height. The quantity of water lifted was then measured under each water level release valve height adjustment setting. The results of these two operating conditions are summarized in the following Table No. 2:

TABLE 2

| RESERVOIR (DYNAMIC) HEAD (m) | WATER LEVEL ABOVE RELEASE VALVE (mm) | WATER LIFT OUTPUT FLOW RATE (cc/min) | CHANGE IN WATER LIFTING OPERATIONS |
|---|---|---|---|
| 2 | 5 | 0 | no change |
| 2 | 10 | 7,200 | no change |
| 2 | 15 | 10,600 | no change |
| 2 | 25 | 12,500 | stopped lifting after 9 hours |
| 6 | 10 | 0 | no change |
| 6 | 15 | 2,100 | no change |
| 6 | 30 | 2,800 | no change |
| 6 | 50 | 3,300 | stopped lifting after 4 hours |

As this example shows, the greater the height of water level above the release valve 16, the greater the pressurized water output flow rate through lift valve mechanism 12. However, the example also shows that automatic operation of the pump will cease if the water level above the release valve is too high because the housing contains too little metered air. Under the first set of operating conditions, a release valve water level of 25 mm stopped the pump after nine hours, and in the second set of operating conditions, automatic operation of the pump ceased after 4 hours when the water level was set at 50 mm.

Aside from drawbacks in use of prior designs of ram pumps due to geometric constraints on the lead pipe, another major problem discouraging their use has been inability to achieve consistent automatic pump operation.

In theoretical operation, the release valve would be abruptly closed, creating the back pressure or "water hammer". The back pressure would impinge upon and open the lift valve, allowing the back pressure surge to perform useful output work by pressurizing and lifting water. When the pressure surge dropped off, the lift valve would close and the release valve open, continuously repeating the process.

Past designs of ram pumps have not been known to achieve continuous automatic operation. While it was comparatively easy to shut the release valve by means of the pressure generated by flowing exhaust water, it has not been easy to open the valve when necessary. To ease release valve opening, it has been common to increase the opening force of the release valve against the water pressure in the pump body by increasing the valve's weight or by biasing it with a spring. Known designs have increased the valve's counteracting opening force to the point where it was equal to between approximately 40 and 60 percent of the hydrostatic pressure generated by the flowing water on the release valve. This high opening force has had a deliterious effect on known pump efficiency. The release valve becomes easier to open with a high opening force but it becomes harder and takes longer to close. A relatively slower closing time reduces lift capacity.

Release valve mechanisms constructed in accordance with the teachings of the present invention have dramatically departed from the past known attempts by using a counterforce opening weight of the valve on the water much less than that used in the past designs. In the present invention, the release valve mechanism only utilizes a counterforce pressure of less than approximately 15 percent of the hydrostatic pressure generated by the reservoir head on the valve. When combined with a lift valve constructed in accordance with the teachings of the invention, which will be described in subpart D below, fully automatic pump operation is achieved.

The significance of relatively light release valve counterforce pressures on the water contained within the pump body is illustrated by the following example.

EXAMPLE 6

Two test runs were performed with a ram pump having a circular outlet of 50 mm diameter and an appropriately sized corresponding release valve. In the first experimental run, a dynamic head h between the release valve and water reservoir was set at a height of 3 m and in the second run it was set at 8 m. In both runs, the water lift flow rate was set at 10,000 cc/min. The release valve's stroke s was then adjusted to provide optimum water lift pressure head for a given weight of the release valve. The release valve weight is defined as the hydrostatic pressure generated by the closed valve acting upon water inside the pump body divided by hydrostatic pressure generated by the dynamic (reservoir) head. Thus the weight is really a ratio of two hydrostatic pressures. The results are summarized in Table No. 3:

TABLE 3

| DYNAMIC (RESERVOIR) HEAD (m) | WEIGHT OF RELEASE VALVE | STROKE (cm) | LIFT (OUTPUT) HEAD (m) |
|---|---|---|---|
| 3 | 0.01 | 4.1 | 12 |
| 3 | 0.02 | 2.1 | 30 |
| 3 | 0.05 | 1.2 | 33 |
| 3 | 0.09 | 0.9 | 31 |
| 3 | 0.12 | 0.7 | 28 |
| 3 | 0.15 | 0.3 | 21 |
| 8 | 0.01 | 5.7 | 32 |
| 8 | 0.02 | 3.2 | 78 |
| 8 | 0.05 | 2.0 | 83 |
| 8 | 0.09 | 1.4 | 84 |
| 8 | 0.12 | 1.1 | 80 |
| 8 | 0.15 | 0.5 | 61 |

The experimental results clearly show that there is an optimal release valve weight and stroke range. If the release valve weight is too small, the valve will close too quickly and the water flowing through the pump body will not be able to generate a sufficiently rapid flow velocity to create a suitable water lift pressure head output.

In the above examples, the release valve head 17 had a cross-sectional surface area of 28 $cm^2$. When the reservoir head was set at 3 m the actual weight of release valve necessary to create a valve weight ratio of 0.02 was 168 gms.

D. Lift Valve Mechanism

Figure 6:
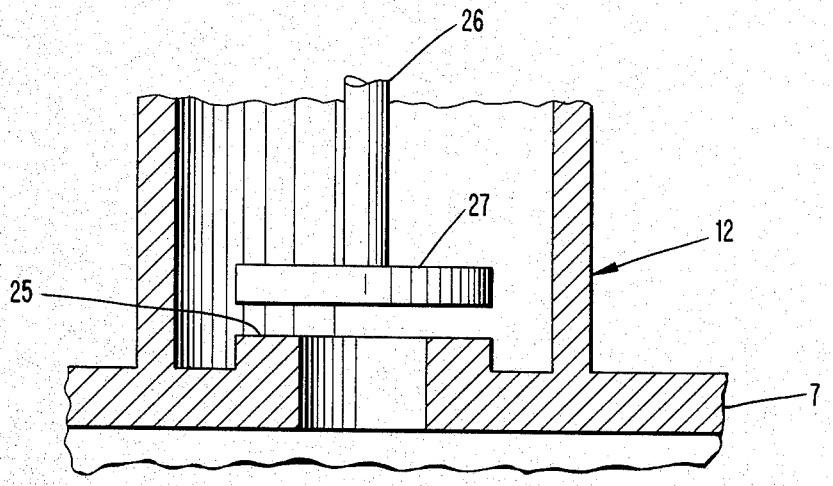
FIG. 6 is a cross-sectional view of a lift valve constructed in accordance with the teachings of the present invention.

FIG. 6 shows a lift valve mechanism constructed in accordance with the teachings of the present invention. Lift valve mechanism 12 has a lift valve outlet 24 formed in the pump housing 7 for output of the back pressure wave. The valve outlet 24 has the valve outlet face 25. A lift valve 26 having valve head 27 cooperates with the outlet face 25 to seal the pump housing by head and face contact pressure when the valve is in the closed position. Lift valve 26 reciprocates to an open position when struck by back pressure of above a threshold level.

In the past, it was though that the lift valve should be constructed to have the minimal possible pressure against outlet face 25, in order to minimize the amount of back pressure.

A lift valve constructed in accordance with the teachings of the present invention, however, departs from past designs and teachings by making the lift valve 26 contact pressure on outlet face 25 relatively high. Some of the back pressure generated within the pump may be wasted by having to expend more back pressure energy to open the lift valve, but the present design allows a much higher initial back pressure generation in the pump.

While a greater percentage of back pressure energy may be wasted opening the lift valve than with the heretofore known lighter weight lift valve, the decrease in energy conservation is compensated by creation of a higher initial back pressure. Therefore, greater lift valve sealing pressure, when used in combination with a relatively light weight release valve as described above, generates higher back pressure within the pump housing and thus increases the pumping capacity. This improved lift valve performance is illustrated by means of the following example.

EXAMPLE 7

In ram pump having a 50 mm diameter inlet, two sets of test runs were performed with a reservoir head of 1 m and 3 m respectively. Contact pressure between lift valve 26 and outlet face 25 has increased and the height of the water lift head was measured. The contact pressure was measured with no water in the pump. The results are summarized in the following Table No. 4:

TABLE 4

| DYNAMIC HEAD (m) | CONTACT PRESSURE BETWEEN VALVE AND OUTLET FACE ($gm/cm^2$) | OUTLET HEAD |
|---|---|---|
| 1 | 5 | No automatic operation. |
| 1 | 10 | 4.5 |
| 1 | 20 | 2.7 |
| 1 | 40 | 2.4 |
| 1 | 60 | 2.2 |
| 1 | 80 | 2.1 |
| 3 | 5 | No automatic operation. |
| 3 | 10 | 12.0 |
| 3 | 20 | 6.8 |
| 3 | 40 | 6.3 |
| 3 | 60 | 6.0 |
| 3 | 80 | 5.8 |

As the results show, if the contact pressure between the valve and outlet face is too small, the pump does not work automatically. When the contact pressure is less than approximately 10 $gm/cm^2$ the back pressure that is created is not sufficient to lift water. If the contact pressure is increased to greater than approximately 10 grams per square centimeter, the ram pump functions automatically. Through the experiments, it was found that if the pressure is increased to more than 20 grams per square centimeter, the pump starts to work automatically, but only after the water lift head becomes higher than the reservoir head. Accordingly, the pump must be manually cycled until sufficient back pressure is obtained to initiate automatic operation.

If the contact surface area between the lift valve outlet face 25 and valve head 27 is 98 $cm^2$, the total weight of the valve must be greater than 980 grams in order to operate the pump automatically and greater than 1960 grams for automatic operation when the water is lifted up a little higher than the dynamic head. Of course, the contact pressure may be obtained by use of a spring, or other biasing means.

E. Summary

Improvements in the lead pipe, release valve mechanism, and lift valve mechanism constructed in accordance with the teachings of the present invention allow for efficient automatic utilization of ram pumps for generation of useful output work pressures. The above examples, tables and figures were for illustrative purposes only and should not be construed to limit the scope of the claims in any way.

I claim:

1. A ram pump powered by a fluid head created by a reservoir located above said pump comprising:

(a) a pump housing;

(b) a lead pipe connected to the reservoir and said pump housing for inflow of fluid from the reservoir into said pump housing;

(c) a release valve mechanism having:

(1) a release valve outlet defined by said housing for exhaust of fluid from said pump;

(2) a release valve cup attached to said housing and cooperating with said outlet, said cup having cup slots in communication with said outlet;

(3) an adjusting ring having ring slots through said ring in a radial direction, said ring adapted for communication with and slidable rotation about said release valve cup, said ring slots cooperating with said valve cup slots to form an outlet port having a cross section, such that rotation of said ring varies said cross section;

(4) a release valve reciprocating valve having a stem portion slidably mounted in said valve cup for movement from an open position, to a closed position, such that said release valve reciprocating valve blocks said outlet in said closed position;

(5) means for biasing said release valve reciprocating valve in said open position, such that a bias force generated thereby when said release valve reciprocating valve is in said closed position is between approximately 2% and 12% of a hydrostatic pressure generated by said reservoir fluid head on said closed release valve reciprocating valve; and (d) a lifting mechanism having:

(1) a lifting valve outlet defined by said housing;

(2) a lifting valve outlet face on said lifting valve outlet;

(3) a reciprocating lifting valve having a valve head, said valve head cooperating with said lifting valve outlet face to contact said lifting valve outlet face and seal said lifting valve outlet when the said reciprocating lifting valve reciprocates to a closed position; and (4) means for biasing said reciprocating lifting valve to said closed position, a bias force generated thereby establishing a contact pressure between said head and lifting valve outlet face greater than approximately 10 $g/cm^2$ without fluid in said pump.

2. The improvement according to claim 1 wherein said release valve reciprocating valve biasing means comprises gravitational force exerted on said release valve reciprocating valve.

3. The improvement according to claim 1 wherein said release valve reciprocating valve biasing means comprises a spring.

4. The improvement according to claim 1 wherein said release valve reciprocating valve has means for selectively adjusting a distance of valve reciprocation from said open position to said closed position.

5. The improvement according to claim 4 wherein said means for selective adjustment of release valve reciprocation includes threads on said release valve reciprocating valve stem and a threaded nut adapted for engagement with said valve stem threads such that threading said nut along said valve stem varies said reciprocation distance.

6. The improvement according to claim 5 wherein said reciprocation distance is adjustable between approximately 5 mm and 40 mm.

* * * * *